United States Patent [19]

Miura et al.

[11] Patent Number: 4,975,023

[45] Date of Patent: Dec. 4, 1990

[54] LOW-RESISTANCE HYDROFOIL

[75] Inventors: Mitsutoshi Miura, Tokyo; Hiroharu Kato, Chiba, both of Japan

[73] Assignee: NKK Corporation, Tokyo, Japan

[21] Appl. No.: 375,862

[22] Filed: Jul. 5, 1989

[30] Foreign Application Priority Data

Jul. 13, 1988 [JP] Japan ..... 63-174097

[51] Int. Cl.[5] ..... F01D 5/14

[52] U.S. Cl. ..... 416/237; 416/235

[58] Field of Search ..... 416/235, 237, 236 R, 416/DIG. 2; 415/914

[56] References Cited

U.S. PATENT DOCUMENTS

| | | | |
|---|---|---|---|
| 1,606,887 | 11/1926 | Moody | 416/237 |
| 1,864,803 | 6/1932 | Clark | 416/236 |
| 3,077,173 | 2/1963 | Lang | 416/237 |
| 4,822,249 | 4/1989 | Eckardt et al. | 416/235 |
| 4,846,629 | 7/1989 | Takigawa | 416/236 R |

FOREIGN PATENT DOCUMENTS

| | | | |
|---|---|---|---|
| 305150 | 12/1919 | Fed. Rep. of Germany | 416/235 |
| 449378 | 9/1927 | Fed. Rep. of Germany | 416/237 |
| 450880 | 12/1912 | France | 416/236 |
| 500042 | 2/1920 | France | 416/235 |
| 2282548 | 3/1976 | France | 416/236 |
| 164590 | 12/1980 | Japan | 416/235 |
| 731075 | 4/1980 | U.S.S.R. | 416/235 |
| 2032048 | 4/1980 | United Kingdom | 416/237 |

*Primary Examiner*—John T. Kwon

*Attorney, Agent, or Firm*—Frishauf, Holtz, Goodman & Woodward

[57] ABSTRACT

A low-resistant hydrofoil comprises at least one concave step arranged backwardly in the direction of a chord of blade of the hydrofoil in parallel with the leading edge of the hydrofoil to form a lamellar cavitation layer on the negative pressure surface of the hydrofoil moving under water. The concave step has depth $\Delta t$ and $\Delta t/C$ is more than 0.001 and less than 0.01, being a chord length. The concave step is $0<x_1/C<0.1$, $x_1$ being a distance from the leading edge of said hydrofoil and C being a chord length.

19 Claims, 6 Drawing Sheets

LOW-RESISTANCE HYDROFOIL

BACKGROUND OF THE INVENTION

1. Field of the Invention

The present invention relates to underwater foils such as foils of a hydrofoil craft, propeller blades of a ship and underwater turbines and blades of a pump moving at high speed under water, and more particularly to low resistance hydrofoils enabling to decrease frictional resistance of the foils by having a lamellar cavitation layer formed on a negative pressure surface of the foils.

2. Description of the Prior Arts

It is known that frictional resistance of a shell plating of a ship against water is decreased by jetting air from an underwater shell plating of the ship and having a lamellar air layer formed on the surface of the underwater shell plating. It has been tried to apply this to a hydrofoil craft.

The hydrofoil craft, however, for which the frictional resistance of foils against water is decreased by jetting air in such a manner as mentioned above, is not put to practical use. The reason for this is that there are great difficulties in setting up an air compressor for jetting air in hydrofoil craft body, necessitating a power for the air compressor and, moreover, mounting a piping and air-blowoff holes in the foils themselves.

SUMMARY OF THE INVENTION

It is an object of the present invention to provide a low resistance hydrofoil which can overcome difficulties in said prior art low resistance hydrofoil, can decrease very easily frictional resistance against water of hydrofoils such as foils of a hydrofoil craft and propeller blades of a ship and blades of a turbine pump, which move under water, and can increase an energy efficiency in driving the hydrofoil craft and the like.

To accomplish said object, the present invention provides a low resistance hydrofoil comprising at least one backward step in the direction of a chord of blade of said hydrofoil substantially in parallel with the leading edge of said hydrofoil to form a lamellar caviation layer on a negative pressure surface of said hydrofoil moving under water.

The above object and other objects and advantages of the present invention will become apparent from the detailed description to follow, taken in connection with the appended drawings.

DESCRIPTION OF THE PREFERRED EMBODIMENT

Figure 1:
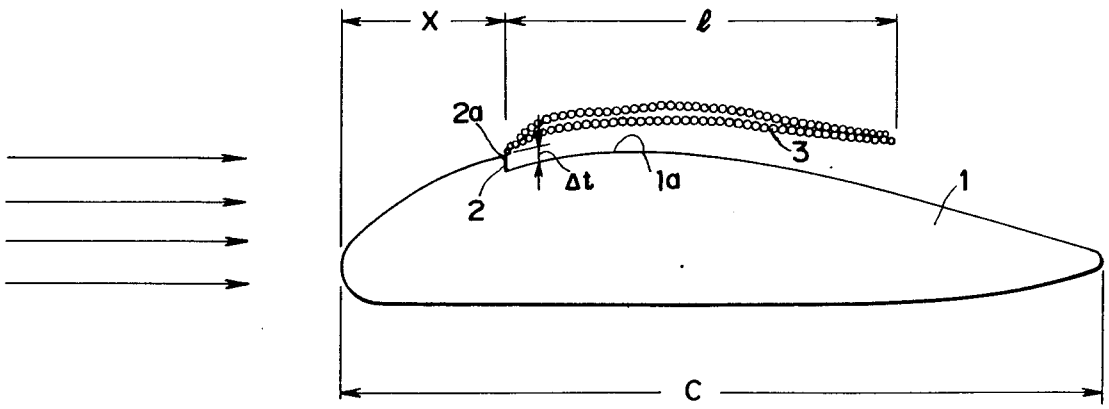
FIG. 1 is a longitudinal sectional view designating an example of the present invention.

An example of the present invention will be described with specific reference to the appended drawings. FIG. 1 is a longitudinal sectional view illustrating a Preferred Embodiment of the present invention. In the drawings, referential numeral 1 denotes a hydrofoil. In FIG. 1, hydrofoil 1 moves to the left under water. A stream of water goes from the left to hydrofoil 1. Then, lamellar cavitation layers 3 are formed on a negative pressure surface 1*a* of hydrofoil 1 by backward concave steps formed in the direction of a chord of blade of said hydrofoil. Thereby, frictional resistance of negative pressure surface 1*a* against water is decreased.

Steps 2 are positioned in parallel with the leading edge of the hydrofoil and downstream portion is smooth in the direction of the chord of blade. Depth $\Delta t$ of each of steps 2 is in the range shown with the following formula (1) in order to have lamellar cavitation layers 3 formed stably, uniformly and thinly on negative pressure surface 1*a*.

$$0.001 < \Delta t/C < 0.01 \quad (1)$$

C is a chord length of the hydrofoil.

When depth $\Delta t$ of each of steps 2 is one thousandth of the chord length of the hydrofoil or less, it is difficult to have a cavitation of a sufficient length produced on negative pressure surface 1*a*. On the other hand, when depth $\Delta t$ of each of steps 2 is one hundredth of the chord length of the hydrofoil or more, since resistance of negative pressure surface 1*a* against water is greatly increased by the steps, a number of cavitations are irregularly produced on negative pressure surface 1*a*. In both of the cases, it is impossible to have lamellar cavitation layers 3 formed stably, uniformly and thinly on negative pressure surface 1*a*. In consequence, it is impossible to produce a favorable effect on a decrease of frictional resistance of negative pressure surface 1*a* against water.

The number of the steps can be one or several in the direction of the chord of blade. The number of the steps can be properly determined in accordance with the length of cavitation layers 3 formed on negative pressure surface 1*a* so that negative pressure surface 1*a* can be sufficiently covered with cavitation layers 3.

Cavitation layers 3 are desired to be formed in a possible range of negative pressure surface 1*a* from an upstream portion of hydrofoil 1 in the direction of the chord of blade. From this viewpoint, position x of step 2 from the leading edge of hydrofoil 1 is preferred to be in the range shown with the following formula (2).

$$0 < x/C < 0.1 \quad (2)$$

In case that a plurality of steps 2 are arranged in the direction of the chord of blade so that the cavitation layers can be formed on the entire negative pressure surface, positions x of from the second step on is $x+\Sigma l_{i-1}$ ($2 \leqq i$, $l_{i-1}$ is a length of a cavitation layer formed by step number $i-1$).

Figure 2:
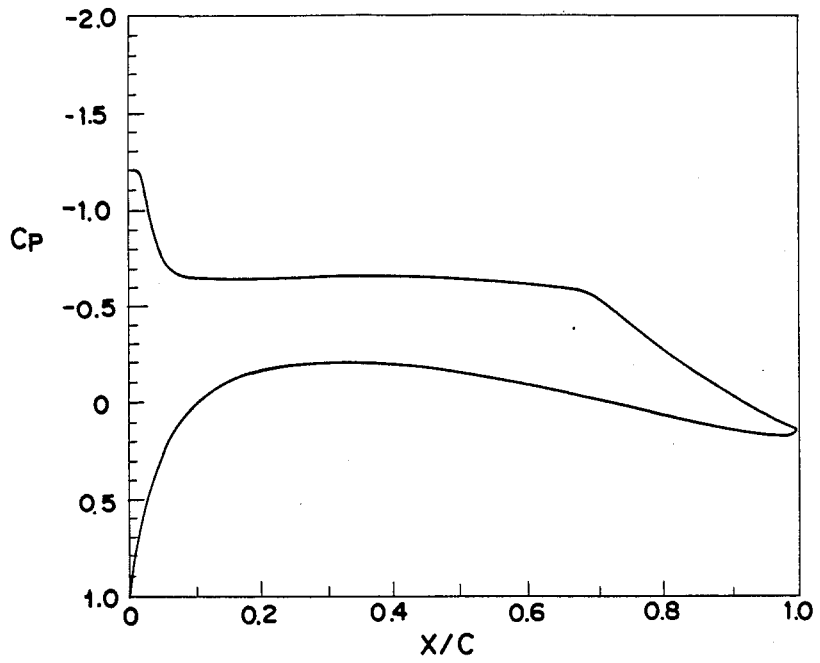
FIG. 2 is a graphical representation showing a distribution of pressure coefficients on negative pressure surface and its opposite surface of a hydrofoil in the direction of a chord of blade when steps are not made.

The reason for limiting x by the formula (2) will be explained with specific reference to FIGS. 2 and 3. FIG. 2 is a graphical representation showing the results of having hydrodynamically calculated a distribution of pressure coefficient on the negative pressure surface and its opposite surface for the hydrofoil of a cross section shown in FIG. 3. A pressure coefficient Cp in the axis of ordinate is determined with the following formula (3):

$$C_p=\Delta p/(\tfrac{1}{2})\rho V^2 \quad (3)$$

Δp: a variation of pressure produced by a flow of water

ρ: density of water

V: a flow speed

Figure 3:
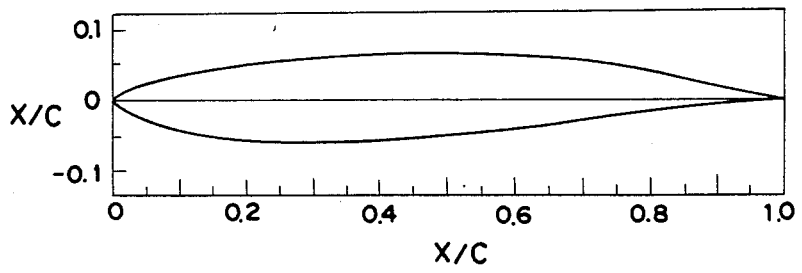
FIG. 3 is a longitudinal sectional view illustrating a hydrofoil, the same as shown in FIG. 2.

The blade section shown in FIG. 3 was written by selecting one from the blade sections having produced a great effect in arrangement of concave steps after having studied various sorts of sections of blades. The axis of ordinate in FIG. 3 was written, a level of nose tail line being zero and $x/C=1$ being a unit as in the axis of abscissa.

As conditions of a water flow on the occasion of the above-mentioned calculation, angle of attack α (an angle made by a direction of blade: a nose tail line, and a direction of a water flow) is 2.5°, Reynolds number $(Re)=10^6$. FIG. 2 shows that the negative pressure is remarkably large in the range of $x/C<0.1$. Accordingly, the cavitation is liable to occur in this range. Therefore, frictional resistance of negative pressure surface 1*a* against water can be decreased by a formation of the cavitation layers.

Figure 4:
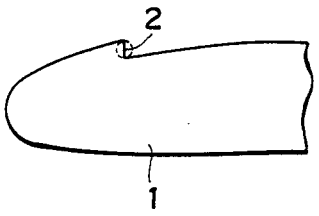
FIGS. 4 to 6 are longitudinal sectional views illustrating steps of various shapes made in a upstream portion in the direction of the chord of blade of the hydrofoil in FIG. 1 according to the present invention.
Figure 5:
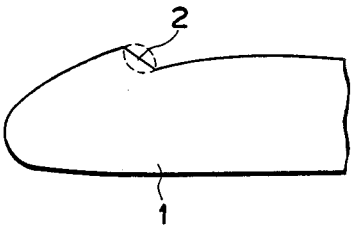
Figure 6:
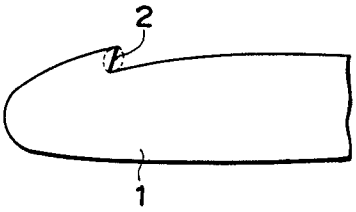

In a shape of the concave portion of step 2, there can be any of upstream portions of step 2 which, as shown in FIGS. 4, 5 and 6, crosses at right angles to a direction of the chord of blade of hydrofoil 1 or which is inclined toward the upstream side or toward the downstream side in the direction of the chord of blade. The shape of the concave portion of step 2 can be of a straight line as shown with a solid line in FIGS. 4 to 6 or concave or convex as shown with a dotted line. The effects of arranging step 2 differ dependent on sections of step 2. However, it is seen that any shape of step 2 decreases a frictional force in comparison with the case that step 2 is not arranged.

According to the hydrofoil as shown in FIG. 1, on negative pressure surface 1*a* of which said step 2 is arranged, the cavitation layers are produced by the turbulence of a water flow entering hydrofoil 1 which is caused by edge 2*a* of the top end of step 2 and lamellar cavitation layers 3 are constantly and continuously formed on negative pressure surface 1*a* backwardly in the direction of the chord of blade. Accordingly, since only frictional resistance caused by cavitation layers 3 small enough to be neglegible is added to a portion where the cavitation layers 3 are formed on negative pressure surface 1*a*, frictional resistance of negative pressure surface 1*a* against water is greatly decreased.

Figure 7:
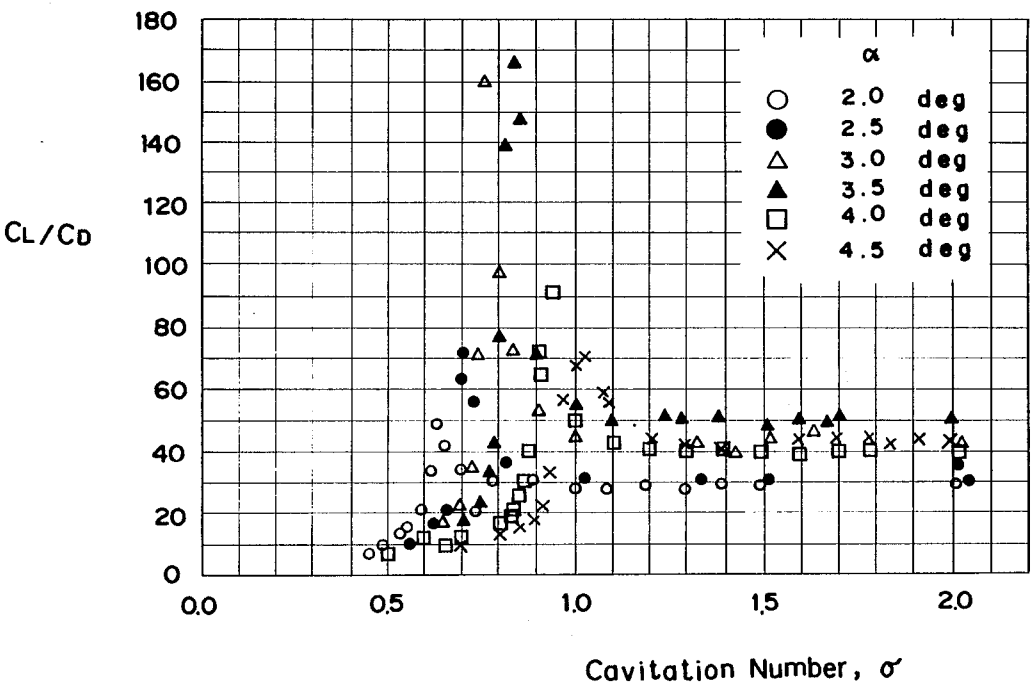
FIG. 7 is a graphical representation indicating the relation between the ratio of lift coefficients to drag coefficients and a cavitation number, an angle of attack being a parameter in the present invention.

The above-mentioned effect of the decrease of the frictional resistance will be described with specific reference to FIG. 7. The axis of ordinate in FIG. 7 represents the ratio of lift coefficient $C_L$ to drag coefficient $C_D$: $C_L/C_D$. When resistance on the negative pressure surface decreases, $C_L/C_D$ increases. This is fit for the object of the present invention. A data of FIG. 7 was measured for the hydrofoil, whose section and size were the same as in FIG. 3. Angle of attack (α) was adopted as parameter. The axis of abscissa represents cavitation number (σ) which is determined by the following formula:

$$\sigma=(p-p_v)/(\rho V^2/2) \quad (4)$$

P: static pressure of a main stream $P_v$: saturated vapor pressure at a temperature of liquid In case of a prior art example in which step 2 was not arranged, $C_L/C_D$ was 53. According to FIG. 7 showing the results obtained by the Preferred Embodiment of the present invention, $C_L/C_D$ reached a peak near $\sigma=0.8$. In the range of angle of attack (α) from 2.5° to 4.5°, $C_L/C_D$ larger than in the prior art example was obtained. A preferable angle of attack (α) is from 3.0° to 4.0° as shown in FIG. 7. When the angle of attack is modified by aspect ratio Λ, angle of attack of from 2.5 to 4.5 and from 3.0 to 4.0 become $2.5+C_L/\Lambda\cdot180/\pi^2<\alpha<4.5+C_L/\Lambda\cdot180/\pi^2$ and $3.0+C_L/\Lambda\cdot180/\pi^2<\alpha<4.0+C_L/\Lambda\cdot180/\pi^2$, respectively.

Figure 8:
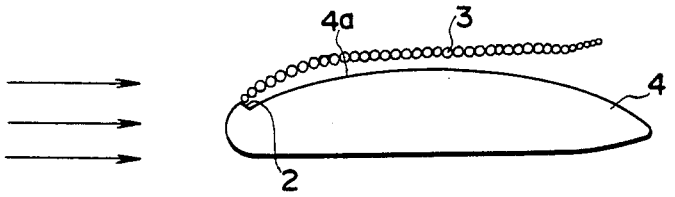
FIGS. 8 and 9 are a longitudinal sectional view and a top-plan view illustrating a formation of cavitation layers on a hydrofoil being a two-dimensional foil respectively according to the present invention.
Figure 9:
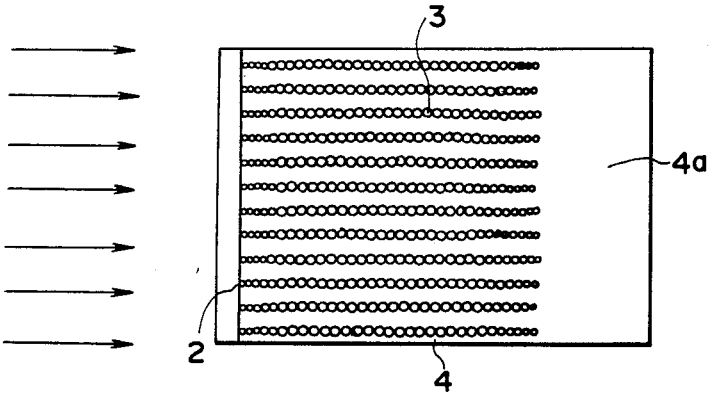
Figure 10:
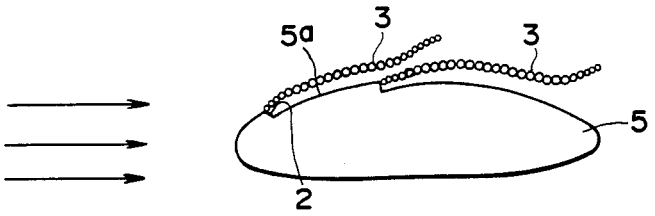
FIGS. 10 and 11 are a longitudinal sectional view and a top-plan view illustrating a formation of cavitation layers on a hydrofoil being a three-dimensional foil comprising propeller blades respectively according to the present invention.
Figure 11:
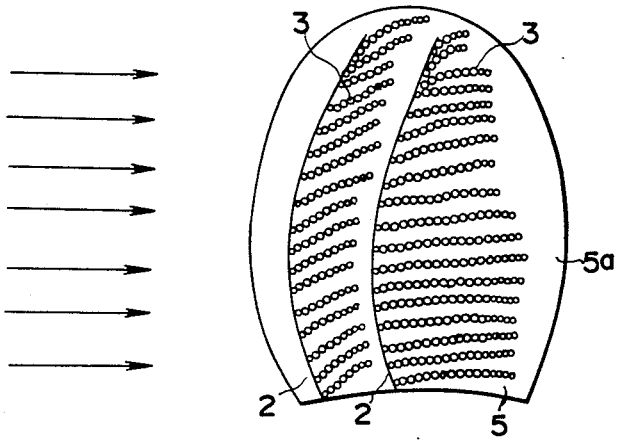

Formation of the cavitation layers on the hydrofoil, to which the present invention was applied, will be shown in FIGS. 8 to 11. FIGS. 8 and 9 are a longitudinal sectional view and a top-plan view illustrating a hydrofoil of two-dimensional blades respectively. FIGS. 10 and 11 are a longitudinal sectional view and a top-plan view illustrating a hydrofoil composed of three-dimensional foil, respectively. Section of the two-dimentional foil in the longitudinal direction of the foil does not change and a shape and an arrangement of steps 2 are comparatively simple. On the other hand, the hydrofoil composed of propeller blades is referred to as a three-dimensional hydrofoil, in which section of the three-dimensional foil changes and single step 2 can not always play its role sufficiently. Therefore, a plurality of steps are often arranged.

As shown in FIGS. 8 and 9, lamellar cavitation layers 3 are formed on negative pressure surface 4*a* by arranging one step 2 in a position close to the leading edge of negative pressure surface 4*a* of hydrofoil 4 of the two-dimensional foil, to which the present invention is applied. Cavitation layers 3 cover negative pressure surface 4*a* from a position of step 2 to the downstream side through a middle portion of the hydrofoil in the direction of the chord of blade and decreases frictional resistance of negative pressure surface 4*a* against water. As shown in FIGS. 10 and 11, lamellar cavitation layers 3 are formed in two positions, one on the upstream side and the other on the downstream side of negative pressure surface 5*a*, by arranging each of steps 2 in a position close to the leading edge of negative pressure surface 5*a* and in a position near the middle portion in the direction of the chord of blade. Cavitation layers 3 on the upstream side and on the downstream side, partially wrapping each other, cover negative pressure surface 4*a* from the position of step 2 close to the leading edge of the hydrofoil to a position close to the trailing edge of the hydrofoil and decrease frictional resistance of negative pressure 5*a* against water.

According to the present invention, frictional resistance against water of a hydrofoil such as foils of a hydrofoil craft, propellar blades of a ship and blades of an underwater turbine and a pump, moving under water, can be very easily decreased without arranging a piping and the like in the hydrofoil as in the case of using an air jet. Accordingly, an energy efficiency in driving the hydrofoil craft and the like can be increased.

What is claimed is:

1. A low-resistance hydrofoil comprising:

a hydrofoil having at least one blade; and at least one step arranged backwardly in a direction of a chord of said blade of said hydrofoil and in parallel with a leading edge of said hydrofoil to form a lamellar cavitation layer on a negative pressure surface of said hydrofoil moving under water;

said at least one step having depth $\Delta t$, and wherein $\Delta t/C$ is more than 0.001 and less than 0.01, and where C is a chord length.

2. The hydrofoil of claim 1, wherein said at least one step is arranged at a distance $x_n$ from said leading edge of said hydrofoil, wherein $x_n$ is as follows:

in the case of $n=1$ $x_n=x_1$ where $0<x_1/C<0.1$ where C is a chord length; and in the case of $n \geqq 2$ $$x_n = x_1 + \sum_{i=2.}^{n} li - 1$$

where i equals to 2 or more, and where $li-1$ is a length of the cavitation layer formed by step number i.

3. The hydrofoil of claim 1, wherein said at least one step has an upstream portion substantially at right angles to the direction of the chord of said blade.

4. The hydrofoil of claim 1, wherein said at least one step has an upstream portion inclined toward the upstream side thereof.

5. The hydrofoil of claim 1, wherein said at least one step has an upstream portion inclined toward the downstream side thereof.

6. The hydrofoil of claim 1, wherein said at least one step has an upstream portion on a straight line.

7. The hydrofoil of claim 1, wherein said at least one step has an upstream portion on a curve.

8. A low-resistance hydrofoil, comprising:

a hydrofoil having at least one blade; and at least one step arranged backwardly in a direction of a chord of said blade of said hydrofoil and in parallel with a leading edge of said hydrofoil to form a lamellar cavitation layer on a negative pressure surface of said hydrofoil moving under water;

said at least one step being arranged at a distance $x_n$ from said leading edge of said hydrofoil, wherein $x_n$ is as follows:

in the case of $n=1$ $x_n=x_1$ where $0<x_1/C<0.1$ where C is a chord length; and in the case of $n \geqq 2$ $$x_n = x_1 + \sum_{i=2.}^{n} li - 1$$

where i equals to 2 or more, and where $li-1$ is a length of the cavitation layer formed by step number i.

9. The hydrofoil of claim 8, wherein said at least one step has an upstream portion substantially at right angles to the direction of the chord of said blade.

10. The hydrofoil of claim 8, wherein said at least one step has an upstream portion inclined toward the upstream side thereof.

11. The hydrofoil of claim 8, wherein said at least one step has an upstream portion inclined toward the downstream side thereof.

12. The hydrofoil of claim 8, wherein said at least one step has an upstream portion on a straight line.

13. The hydrofoil of claim 8, wherein said at least one step has an upstream portion on a curve.

14. A low-resistance hydrofoil comprising:

a hydrofoil having at least one blade; and at least one step arranged backwardly in a direction of a chord of said blade of said hydrofoil and in parallel with a leading edge of said hydrofoil to form a lamellar cavitation layer on a negative pressure surface of said hydrofoil moving under water;

wherein said at least one step is defined by $0<x_1/C<0.1$, where $x_1$ is a distance from the leading edge of said hydrofoil and C is the length of said chord.

15. The hydrofoil of claim 14, wherein said at least one step has an upstream portion substantially at right angles to the direction of the chord of said blade.

16. The hydrofoil of claim 14, wherein said at least one step has an upstream portion inclined toward the upstream side thereof.

17. The hydrofoil of claim 14, wherein said at least one step has an upstream portion inclined toward the downstream side thereof.

18. The hydrofoil of claim 14, wherein said at least one step has an upstream portion on a straight line.

19. The hydrofoil of claim 14, wherein said at least one step has an upstream portion on a curve.

* * * * *